United States Patent [19]

Moore

[11] Patent Number: 4,715,518

[45] Date of Patent: Dec. 29, 1987

[54] DISPENSER FOR STRIPED VISCOUS PRODUCTS

[75] Inventor: David G. Moore, Lee's Summit, Mo.

[73] Assignee: Realex Corporation, Lee's Summit, Mo.

[21] Appl. No.: 926,853

[22] Filed: Oct. 3, 1986

Related U.S. Application Data

[63] Continuation of Ser. No. 631,258, Jul. 16, 1984, abandoned.

[51] Int. Cl.[4] ..... G01F 11/00

[52] U.S. Cl. ..... 222/257; 222/260; 222/320; 222/340; 222/386

[58] Field of Search ..... 222/256, 260, 386, 387, 222/391, 94, 257, 340

[56] References Cited

U.S. PATENT DOCUMENTS

| | | | |
|---|---|---|---|
| 2,341,031 | 2/1944 | Flynn | 222/387 |
| 2,944,705 | 7/1960 | Strumor | 222/94 |
| 3,405,845 | 10/1968 | Cook et al. | 222/387 |
| 4,323,175 | 4/1982 | Eckert | 222/256 |
| 4,437,584 | 3/1984 | Connors et al. . | |
| 4,461,403 | 7/1984 | Prahs . | |
| 4,511,068 | 4/1985 | Bossina | 222/320 |

FOREIGN PATENT DOCUMENTS

| | | | |
|---|---|---|---|
| 472508 | 9/1937 | United Kingdom | 222/387 |

*Primary Examiner*—H. Grant Skaggs

*Attorney, Agent, or Firm*—Schmidt, Johnson, Hovey & Williams

[57] ABSTRACT

In a manually operated dispenser especially suited for striped toothpaste products and the like the reciprocable pumping piston is provided with a concave, product-engaging face that gently, yet forcibly, directs the product in a smooth, laminar flow out of the pump chamber and into the discharge spout when the piston is depressed through a pumping stroke so that stripes in the ribbon of toothpaste issuing from the spout are well defined and maintained in an aesthetically pleasing manner. The cooperating floating takeup piston at the opposite end of the chamber from the pumping piston is provided with a convex dome that becomes complementally received within the concavity of the pumping piston when the contents of the dispenser are nearly depleted, thereby maximizing the degree to which the dispenser is emptied.

5 Claims, 2 Drawing Figures

DISPENSER FOR STRIPED VISCOUS PRODUCTS

This application is a continuation of application Ser. No. 631,258 filed July 16, 1984, now abandoned.

TECHNICAL FIELD

This invention relates to the field of manually operated pumping dispensers and, more particularly to improvements in dispensers of the type which are especially adapted for handling viscous products such as striped toothpaste and the like.

BACKGROUND

A dispenser for pastry products of the subject type is illustrated in prior U.S. patent application Ser. No. 565,540, filed Dec. 27, 1983, in the names of John M. B. Ford, et al., and titled "PASTRY PRODUCT DISPENSER HAVING COMBINATION ACTUATOR AND OUTLET VALVE" owned by the assignee of the present invention, and now U.S. Pat. No. 4,691,847. While the principles disclosed and claimed in such prior application are sound and dispensers constructed in accordance with those teachings have performed quite well for their intended purposes, further improvements have now been discovered which make dispensers of that type especially well suited for striped toothpaste products and the like where preserving the integrity and clear definition of the stripes within the dispensed bead of toothpaste is extremely important for aesthetic, user appeal reasons.

SUMMARY OF THE PRESENT INVENTION

Accordingly, one important object of the present invention is to provide a dispenser that is especially, although not exclusively, suited for dispensing a viscous, axially striped product by virtue of the dispenser's ability to pump the product under pressure without destroying or otherwise adversely affecting the integrity and clear definition of the stripes throughout the product.

To this end, the reciprocable pumping piston of the dispenser is provided with a product engaging face that is concave in nature so as to gently guide the product in a laminar flow into the centrally disposed outlet passage associated with the piston during the pumping stroke. The avoidance of turbulence, agitation and sharp directional changes in the product as it subjected to pumping pressures has been found to be especially beneficial in preserving the integrity of the stripes. Moreover, constructing the pumping piston in a manner to achieve such results has also led to a decrease in the finger pressure required to manually effect a pumping stroke and to a decrease in any deformation of the piston face which could otherwise lead to undesirable product blow-by around the sealing interface between the piston and the walls of the pumping chamber.

As a result of the concave piston face, it has also been found desirable to provide the lower takeup piston of the dispenser with a convex product engaging face complemental to the face of the pumping piston. This results in several benefits including, for example, maximizing the degree of evacuation of product from the pump chamber as the convex face becomes received and nested within the concave face of the pumping piston upon full depletion of the product, and improved sealing around the interface between the takeup piston and the walls of the chamber.

DESCRIPTION OF THE PREFERRED EMBODIMENT

Figure 1:
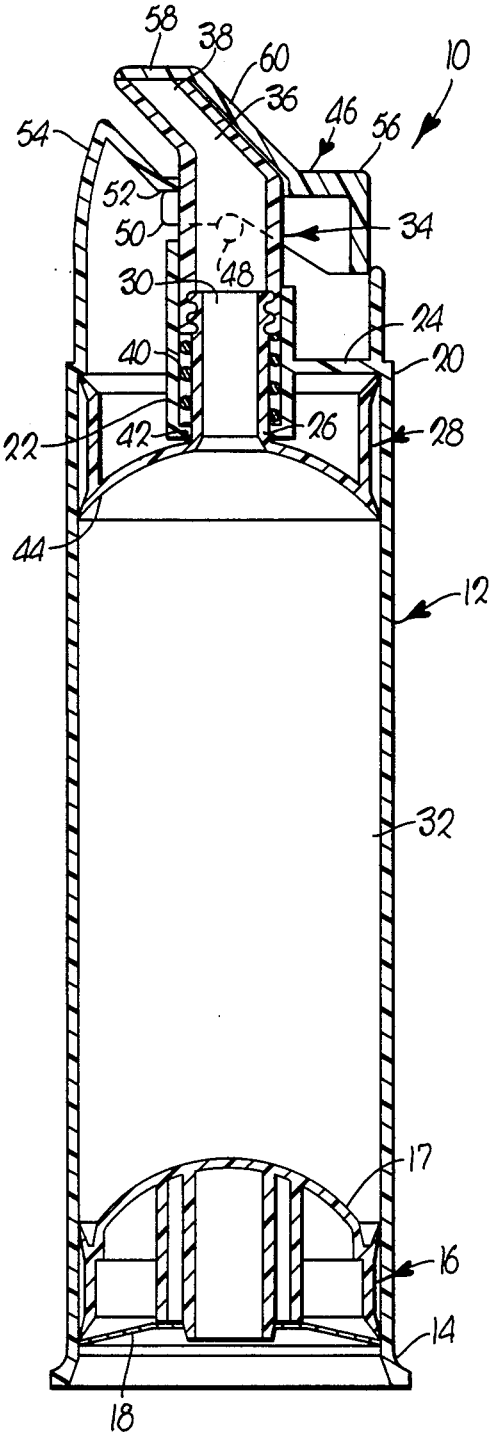
FIG. 1 is a vertical cross-sectional view of a dispenser constructed in accordance with the principles of the present invention with the actuating lever thereof in its undepressed, standby position and the spout outlet closed by the valve portion of the lever.
Figure 2:
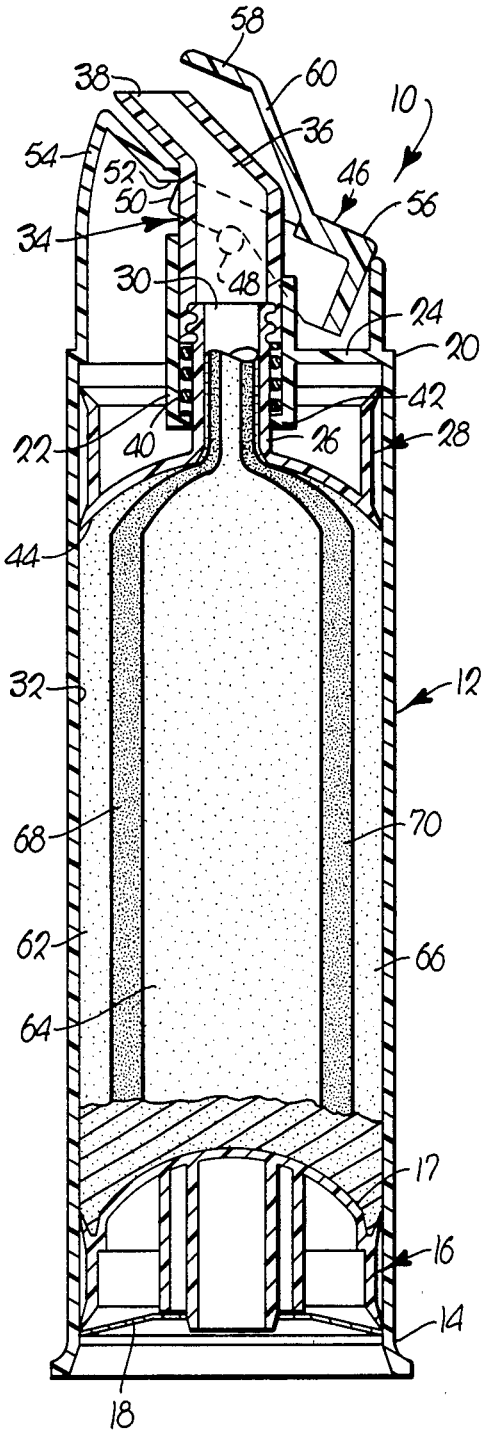
FIG. 2 is a vertical cross-sectional view of the dispenser similar to FIG. 1 but showing the dispenser filled with a striped product and the actuating lever depressed.

FIGS. 1 and 2 show a dispenser 10 having a tubular cylindrical body 12 which is open at its lower end 14 to the atmosphere, except for the presence of a floating piston 16 which makes sealing engagement with the interior wall surface of the body 12 and has a downwardly and outwardly flaring metal skirt 18 or the like on the bottom side thereof which also engages the interior wall surface of the body 12. The skirt 18 is sufficiently resilient that it will deflect downwardly to any extent necessary to permit the piston 16 to move upwardly in the body 12 yet is sufficiently stiff as to bite into the wall surface and prevent downward, retrograde movement of the piston 16 within the body 12. The opposite upper end 20 of the body 12 includes an upright, centrally disposed, reduced-diameter sleeve 22 which is supported by transversely extending web means 24.

The sleeve 22 reciprocably receives the tubular stem 26 of a pumping piston 28 which at its circumferential periphery sealingly engages the inner wall surface of the body 12. A passage 30 is defined within the tubular stem 16, and the two pistons 16 and 28 cooperate with the body 12 to form a pumping chamber 32 therebetween.

The sleeve 22 also partially receives the lower end of a tubular discharge spout 34 which itself receives the upper end of the plunger stem 26 and is securely attached thereto. A passage 36 is defined within the tubular spout 34, and a discharge outlet 38 is presented at the uppermost end thereof. A coil spring 40 encircles the piston stem 26 and is trapped between the lower extremity of the spout 34 and a lower, inturned terminus 42 of the sleeve 22 for the purpose of yieldably biasing the piston 28 and the spout 34 toward an upper, undepressed position as illustrated in FIG. 1.

The dispenser 10 is also provided with an actuator 46 in the form of a lever having a fulcrum 48 associated with the spout 34. The fulcrum 48 takes the form of a pair of pins projecting laterally from opposite sides of the spout 34, and a pair of legs 50 of the actuator 46 (only one leg 50 being illustrated) straddle the spout 34 and rest at their midpoints on the respective fulcrum pins 48. Forwardmost ends of the legs 50 are retainingly hooked beneath overhanging proximal ledges 52 (only one being shown) on upstanding housing structure 54 at the upper end 20 of the body 12.

The actuator lever 46 includes a finger-engaging portion 56 on one side of the fulcrum pins 48, as well as a valve flap portion 58 on the opposite side of the fulcrum pins 48. The valve portion 58 is integrally connected with the finger-engaging portion 56 by an intermediate web portion 60, and it will be noted that the valve portion 58 is of such a dimension as to completely cover and thereby close the outlet 38 when the actuator 46 is in its FIG. 1 position. If desired, the spout 34 may have an angled upper end as shown in order to best accommodate the valve portion 58 and a web portion 60 of actuating lever 46.

The pumping piston 28 has a lower, product-engaging face 44 which is of smoothly arcuate, concave configuration. It is to be noted that although the face 44 is arcuate in the illustrated embodiment, it is also within the concepts of the present invention to provide such face 44 with sloping flat surfaces that converge toward the passage 30. The number of such sloping surfaces is largely discretionary.

The lower takeup piston 16 is provided with an upper, product engaging face 17 that is of smoothly arcuate, convex configuration complemental to that of the face 44 of pumping piston 28. Once again, although face 17 has been disclosed herein as being smoothly arcuate, it is within the scope of the present invention to achieve its convex configuration through sloping flat surfaces or the like, although it is preferred that, in any event, the face 17 be configured in a corresponding and complemental way with respect to the face 44.

OPERATION OF THE PREFERRED EMBODIMENT

The return spring 40 normally maintains the pumping piston 28, the spout 34, and the actuator 46 in the position of FIG. 1 in which the valve flap 58 tightly covers and seals the outlet 38. Upon the application of downwardly directed finger pressure to the operating portion 56 of the actuator 46, the latter rocks downwardly about the fulcrum pins 48 in a clockwise direction so that the valve flap 58 is lifted off the outlet 38 in substantially the same manner as illustrated in FIG. 2. At the same time, because the legs 50 are retained beneath the ledges 52, depression of the operating portion 56 also causes the spout 34 and hence the pumping piston 28 to be shifted downwardly a short distance. This exerts a positive pumping pressure on the product contained within the chamber 32, forcing the same upwardly through the passages 30 and 36 and out the outlet 38.

When pressure on the operating portion 56 is released, the spring 40 returns the spout 34 to its original raised position of FIG. 1 and likewise forces the pumping piston 28 back to its original position. By virtue of the fulcrum pins 48 moving upwardly at this time and the legs 50 being trapped beneath the ledges 52, the actuator 46 is rocked in a counterclockwise direction about fulcrum pins 48 to thereby return the operating portion 56 to its original undepressed position and to lower the flap 58 once again into covering relationship with the outlet 38. In view of the evacuation of product within the chamber 32 and the closing of the outlet 38 by valve flap 58, the floating piston 16 is caused to be moved upwardly within the chamber 32 by a corresponding amount as atmospheric pressure is applied against the bottom of the piston 16 by the open lower end 14 of the body 12.

The gently arcuate, concave face 44 of the pumping piston 28 has the effect of easing the transfer of product from within the pumping chamber 32 to the spout 34. In this respect, whereas in prior dispensers the pumping face of the piston is normal to the path of travel of product therethrough and the product must therefore be converged centrally and turned sharply and abruptly at right angles, in the present invention downward movement of the pumping piston 28 tends to deflect or guide the product gently inwardly while at the same time pressing downwardly to force the product up through the passage 30.

This is quite significant when the product being dispensed has a number of axial stripes of sharply contrasting colors as illustrated in Fig. 2 where, for example, the stripes 62, 64, and 66 may be white, the stripe 68 red, and stripe 70 aqua. By converging the outer portions of the product inwardly toward the passage 30 at an oblique angle to the latter during the pumping stroke, it has been found that the stripes are much more prone to maintain their sharp, contrasting definition so that the bead of product ultimately dispensed will be aesthetically pleasing.

It has also been found that the concave configuration of the piston face 44 yields improved structural integrity as compared to prior pumping pistons having thin faces disposed normal to the path of product flow. In this respect it has been observed that the pressures developed during a pumping stroke had a tendency to deflect and deform such prior piston faces, thus also tending to pull the sealing peripheries thereof away from their interface with their pumping chamber. This could result in product blow by and leakage around the pumping piston under some conditions.

Furthermore, it has been noted that the concave configuration of the piston face 44 reduces the finger pressure required to depress the piston 28. Helpful in this regard is the lack of turbulence and agitation involved during the pumping action, all of which enhances the ease with which the piston 28 may be depressed.

On the other hand, the convex configuration of the takeup piston 16 assures that as the latter approaches the upper limits of its travel, the face 17 thereof will be complementally received by the concavity of the pumping piston 28. Consequently, evacuation of the product within chamber 32 is maximized, there being no remaining space for entrapment of product residue between the complemental faces 44 and 17 once the takeup piston 16 has fully risen into engagement with the piston 28.

Furthermore, it is believed that as a result of the convex configuration applied to the takeup piston face 17, an enhanced peripheral sealing action is obtained between takeup piston 16 and the walls of the chamber 32, perhaps as a result of product forces being directed downwardly along the domed face 17 and generally outwardly toward the sealing periphery of the piston 16.

It will of course be understood that the foregoing sets forth but one exemplary embodiment of the present invention. Various modifications within the spirit and scope of this invention will be apparent to those skilled in the art, and such modifications can obviously be made without departing from the underlying principles of the invention.

I claim:

1. In a manually operated dispensing pump, the improvement comprising:

a hollow cylindrical body defining an internal product chamber;

a pumping piston at one end of the body supported for reciprocal movement through repeated strokes of limited length toward and away from the opposite end of the body, said piston having yieldable means associated therewith for returning the piston to its original position following each dispensing stroke and having a centrally disposed, axially extending discharge passage in continuously open communication with said product chamber;

a discharge spout having an internal outlet passage of reduced diameter compared to the product chamber in continuously open communication with said discharge passage of the piston;

a take-up piston at the opposite end of the body from the pumping piston movable toward the pumping piston under the force of atmospheric pressure outside of the body and subatmospheric pressure inside of the body following each dispensing stroke of the pumping piston whereby to reduce the volume of the product chamber by an amount which corresponds to the volume of product dispensed during the immediately preceding dispensing stroke, said take-up piston having means associated therewith for preventing retrograde movement of the take-up piston in a direction away from the pumping piston during the dispensing stroke of the pumping piston;

a viscous product mass within said product chamber containing a plurality of circumferentially spaced apart, axially extending product stripes of different colors, said pumping piston having a smooth, concave, product-engaging face surrounding the discharge passage thereof and extending radially outwardly across the width of the product chamber for gently funneling the striped product mass laterally inwardly into and axially through said passages during movement of the pumping piston through its dispensing stroke, whereby to produce an axially striped, multi-colored bead of product emanating from the spout whose stripes are proportionately closer together and narrower than the stripes of the mass in the product chamber, said passages of the pumping piston and the spout being devoid of internal obstructions to product flow throughout their full lengths whereby to preserve and maintain the integrity of the multi-colored stripes in the product passing through said passages; and actuating means operably coupled with said pumping piston for operating the same.

2. In a manually operated dispensing pump as claimed in claim 1, said take-up piston having a convex product-engaging surface substantially matching the concave configuration of said face of the pumping piston.

3. In a manually operated dispensing pump as claimed in claim 1, said discharge spout having an outlet through which the striped bead of product emanates from the spout, said actuating means including an operating lever having a rigid valve flap at one end thereof operable to open the outlet during a dispensing stroke of the pumping piston and to sealingly close the outlet in the manner of a check valve upon return of the pumping piston to its original position whereby to prevent suckback of product in the spout.

4. In a manually operated dispensing pump as claimed in claim 1, said face of the pumping piston being arcuately concave.

5. In a manually operated dispensing pump as claimed in claim 1, said discharge spout being secured to said pumping piston for reciprocation therewith.

* * * * *